United States Patent [19]

Clements

[11] 4,170,299

[45] Oct. 9, 1979

[54] RACK AND TIE-BACK CLIP ASSEMBLY

[75] Inventor: Alan Clements, Tappan, N.Y.

[73] Assignee: Ben Clements & Sons, Inc., South Hackensack, N.J.

[21] Appl. No.: 867,072

[22] Filed: Jan. 5, 1978

[51] Int. Cl.[2] ..... B65D 85/24; A44B 21/00

[52] U.S. Cl. ..... 206/342; 206/493; 24/243 R; 24/81 AF; 24/67.9

[58] Field of Search ..... 206/493, 342; 215/1.8; 24/243 R, 67.9, 81 A, 81 AG

[56] References Cited

U.S. PATENT DOCUMENTS

| | | | |
|---|---|---|---|
| 1,720,295 | 7/1929 | Schwartzman | 24/81 AF |
| 2,008,539 | 7/1935 | Begle | 206/342 |
| 2,370,417 | 2/1945 | Preston | 206/493 |
| 2,610,654 | 9/1952 | Ahlstrand | 206/493 |
| 3,462,803 | 8/1969 | Horton | 24/243 R |
| 3,797,076 | 3/1974 | Watkin | 24/67.9 |

FOREIGN PATENT DOCUMENTS

| | | | |
|---|---|---|---|
| 1228878 | 3/1960 | France | 24/81 A |

*Primary Examiner*—Davis T. Moorhead

*Attorney, Agent, or Firm*—Blum, Moscovitz, Friedman & Kaplan

[57] ABSTRACT

In a rack and tie-back clip assembly, the clips are joined in pairs by a cord and are held in a linear array on the rack. The clips can be disengaged in pairs from the rack, the mounting arrangement of the clips on the rack being such that entanglement of the cords does not occur either in storage or during removal of the clips. The rack has bars which sit within slots in the clips so as to prevent rotation of the clips while held in the rack. In a preferred arrangement, each rack holds two rows of clips, the clips lying against each other so as to provide additional stability to the assembly.

13 Claims, 5 Drawing Figures

FIG. 1
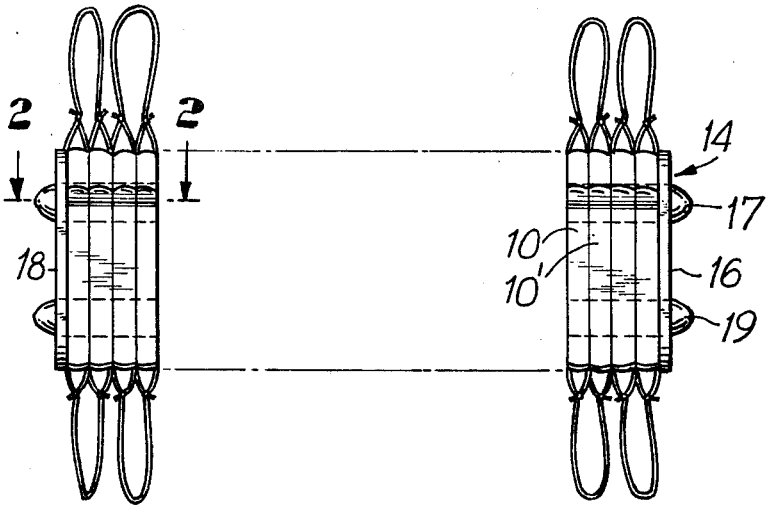
FIG. 2
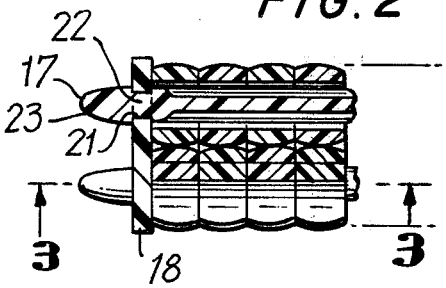
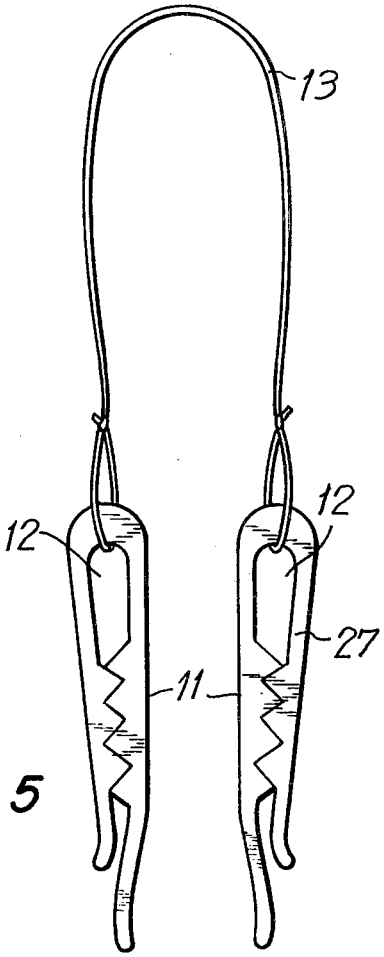
FIG. 5
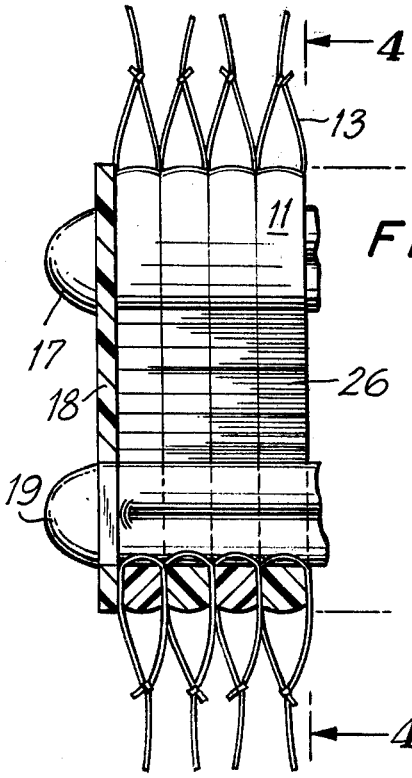
FIG. 3
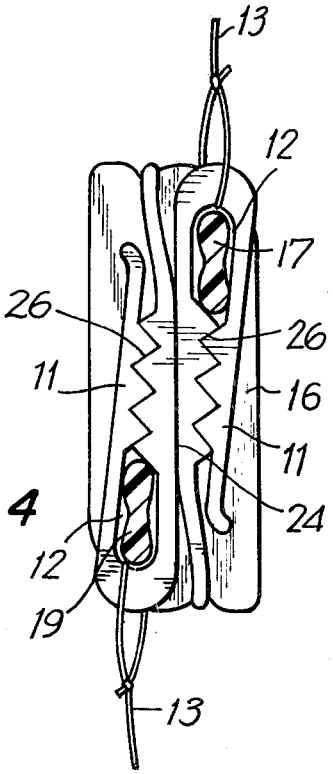
FIG. 4

RACK AND TIE-BACK CLIP ASSEMBLY

BACKGROUND OF THE INVENTION

Pairs of tie-back clips, attached to each other by a cord, have a wide variety of uses, particularly with respect to display, sale and packaging of clothing. Thus, pairs of gloves may be attached to each other, a matching blouse and skirt may be similarly attached and the loss of a belt from a matching loopless garment may be prevented. In the display area, a pair of clips, preferably attached to each other by an elastic cord, may be used to draw a garment tightly against a form.

The packaging of such tie-back clips has presented a problem due to the tendency of the cords to become entangled. Generally, the cords are rather short and it has been a common practice to lay the cords of a number of pairs of clips together and to form a tight cylinder of tape around the cords, leaving the clips at the end free. About a dozen pairs of clips may be packaged in this way. However, when it is desired to use only one or two pairs of clips, the package must nevertheless be broken. The remaining sets of clips must then be stored in a box or other container. As a result, the pairs may readily become entangled entailing a loss in time when it is desired to remove additional sets of clips from the box. Moreover, storage containers must be provided.

As is evident, it would be highly desirable that a rack be provided which can hold the clips in such a way that entanglement can be prevented and so that a few or as many pairs of clips as may be desired can readily be removed. Moreover, the assembly should be such that additional storage containers need not be provided.

SUMMARY OF THE INVENTION

In a rack and tie-bar clip assembly, the rack includes at least one end plate and one bar, the bar being attached to the end plate proximate one end of said bar. Each of the clips has a slot therethrough for receiving the bar, the shape of the slot in the cross-section of the bar being such as to prevent rotation of the clips around the bar. The clips are joined together by a cord, preferably of elastic, and the clips are mounted in pairs on the bar from which they can be readily removed for use. The bar may be joined to the end plate by means of an aperture in the end plate and a notch proximate the end of the bar. The material of which the end plate is made is sufficiently flexible so that the bar can be inserted far enough into the aperture so that the notch is seated in the aperture.

In a preferred arrangement, the rack has two end plates and two bars, each of the end plates having two apertures for receiving the ends of the two bars, the bars being spaced apart for holding two linear arrays of clips. At least one of the end plates is attached removably to the bars so that it can readily be freed therefrom for taking clips, in pairs, from the bars. In this embodiment the clips are preferably held so that one array is reversed with respect to the other and the two arrays make contact with each other.

Accordingly, an object of the present invention is a rack and tie-back clip assembly in which the tie-back clips are held in one or more linear arrays on the rack.

Another object of the present invention is a rack and tie-back clip assembly in which pairs of tie-back clips attached to each other by a cord may be held without entanglement of the cords.

A further object of the present invention is a rack and tie-back clip assembly in which one or more linear arrays of tie-back clips may be held for ready dispensing and in which the rack can be molded.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is an elevational view of a rack and tie-back clip assembly in accordance with the present invention;

FIG. 2 is a view along line 2—2 of FIG. 1;

FIG. 3 is a view along line 3—3 of FIG. 2;

FIG. 4 is a view along line 4—4 of FIG. 3; and

FIG. 5 is a pair of tie-back clips joined by a cord.

DESCRIPTION OF THE PREFERRED EMBODIMENTS

A pair of tie-back clips 11 is shown in face view in FIG. 5, said tie-back clips being generally U-shaped, the legs of said U-shape being in close proximity to each other. In addition, each of said clips has a slot 12 therethrough and the clips are joined by a cord 13 passing through said slots. Preferably, cord 13 is of an elastic material.

For shipping and storage clips 11 are mounted on a rack indicated generally by the reference numeral 14, (FIG. 1), rack 14 including at least one end plate 16 and at least one bar 17 affixed to said end plate 16 proximate one end of said bar 17.

Clips 11 are mounted in linear array and in pairs on bar 17, bar 17 being received in slots 12, and the two clips in each pair being mounted contiguous with each other as shown in FIG. 1, the members of a representative pair being given the reference numerals 10 and 10'. In the embodiment shown in FIG. 1, rack 14 includes two end plates 16 and 18 and two bars 17 and 19. Through the use of two bars 17 and 19, two rows or linear arrays of clips 11 may be held on a single rack. Where only one end plate is used, the clips 11 may be positioned on the bar 17, for instance, by positioning the clips so that slots 12 and the free end of the bar are in registry, after which the clips are slid onto the bar. The slot is formed by making a groove 27 in at least one of the legs of the U. Where the rack is to have two end plates as shown in FIG. 1, at least one of the end plates must be removable. A convenient way to effect this arrangement is shown in FIG. 2 wherein end plate 18 has an aperture 21 therein and bar 17 has a notch 22 therein, the shapes of aperture 21 and notch 22 being such that they engage each other and such that bar 17 is prevented from rotating within aperture 21. Preferably, end plates 16 and 18 are of an injection-molded resin which is sufficiently flexible so that aperture 21 can be spread by the tapered end 23 of bar 17 as the bar is inserted therein and the bar can be inserted far enough so that aperture 21 is engaged with notch 22.

Bars 17 and 19 match slots 12 in clips 11 as can best be seen in FIG. 3. Bar 19 engages slots 12 in clips 11 so that the clips are prevented from rotation around the bar.

Slots 12 may be regarded as being formed in either one or both of the legs of the U-shaped clip.

In a preferred form the rack holds two rows of tie-back clips, the clips in one row lying in close proximity to the clips in the other row as best shown in FIG. 4. Bars 17 and 19 are shaped to mate with slots 12 for holding the rows of clips so that rotation around the bars is prevented. Contact between the rows of clips 11 at surfaces 24 provides additional stability against rotation.

Each of the clips 11 is provided on the surfaces of the legs which make contact with each other with serrations or teeth 26. In the preferred embodiment, these teeth mate with each other when the clips are not in use, thus providing that the clips will occupy a minimum of space during storage.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. Rack and tie-back clip assembly, said rack being arranged for holding said tie-back clips in a linear array from which said clips can readily be disengaged in pairs, the two clips in each pair being joined by a cord, comprising an end plate and a bar having two ends, said end plate having an aperture therein for gripping said bar proximate one of said two ends, each of said clips having a slot therethrough for receiving said bar, said bar in cross-section and said slot having mating shapes such as to prevent rotation of said clips around said bar, the two clips comprising each pair being positioned proximate each other on the same bar, said cord, said two clips and that portion of said bar between said pair forming a closed loop which is thereby free of the danger of becoming entangled with the cord on any other pair of clips.

2. The assembly as defined in claim 1, wherein said bar has a notch proximate said one end for reversibly engaging the rim of said aperture, said end plate being of a material flexible enough to permit insertion of said bar in said aperture by spreading the rim of said aperture.

3. The assembly as defined in claim 1, wherein the number of bars and the number of apertures are each two and said bars and said apertures are spaced for holding two linear arrays oriented at 180° to each other.

4. The assembly as defined in claim 3. wherein said bars are disposed for holding said linear arrays in contact with each other to provide additional resistance to rotation around said bars.

5. The assembly as defined in claim 2, wherein the number of end-plates is two, each of said end plates having at least one aperture for receiving at least one bar.

6. The assembly as defined in claim 1, wherein the number of end plates is two, the number of bars is two, and each of said end plates has two apertures for holding said bars, each of said bars having two ends and a notch proximate each end thereof for engaging the rims of said apertures.

7. The assembly as defined in claim 1, wherein each of said clips is essentially U-shaped with the legs of said U proximate each other, at least one of said legs having a groove therein forming a wall of said slot for receiving said bar.

8. The assembly as defined in claim 7, wherein the legs of said clips have inner surfaces directed toward each other and teeth on said inner surfaces for grasping objects to be held thereby.

9. The assembly as defined in claim 1, wherein said cords are of an elastic material.

10. The assembly as defined in claim 1, wherein at least said rack is of injection-molded resin.

11. The assembly as defined in claim 2, wherein the number of end plates is two, the number of bars is two and each of said end plates has two apertures for holding said bars, each of said bars having two ends and a notch proximate each end thereof for engaging the rims of said apertures.

12. The assembly as defined in claim 3, wherein the number of end plates is two, the number of bars is two and each of said end plates has two apertures for holding said bars, each of said bars having two ends and a notch proximate each end thereof for engaging the rims of said apertures.

13. The assembly as defined in claim 4, wherein the number of end plates is two, the number of bars is two and each of said end plates has two apertures for holding said bars, each of said bars having two ends and a notch proximate each end thereof for engaging the rims of said apertures.

* * * * *